United States Patent [19]

Rechenbach

[11] Patent Number: 4,998,428

[45] Date of Patent: Mar. 12, 1991

[54] METHOD OF CLEANING STAMPING DIES

[75] Inventor: William S. Rechenbach, Traverse City, Mich.

[73] Assignee: General Motors Corporation, Detroit, Mich.

[21] Appl. No.: 395,400

[22] Filed: Aug. 17, 1989

[51] Int. Cl.[5] ..... B21D 22/00; B21C 43/00; B21C 35/06

[52] U.S. Cl. ..... 72/40

[58] Field of Search ..... 29/81 R; 72/38, 39, 72/40, 46; 15/1, 3

[56] References Cited

U.S. PATENT DOCUMENTS

| | | | |
|---|---|---|---|
| 3,799,178 | 3/1974 | Anderson et al. | 134/58 R |
| 3,914,817 | 10/1975 | Lindsay | 15/3 |
| 4,586,365 | 5/1986 | Henkelmann | 72/39 X |

FOREIGN PATENT DOCUMENTS

| | | | |
|---|---|---|---|
| 2342170 | 2/1975 | Fed. Rep. of Germany | 72/39 |
| 2351731 | 12/1977 | France | 72/39 |
| 63-199022 | 8/1988 | Japan | 72/40 |

*Primary Examiner*—E. Michael Combs

*Attorney, Agent, or Firm*—Ernest E. Helms

[57] ABSTRACT

A method for cleaning waste particles from the die surfaces of a die press includes providing a blank of material with adhesive layers on both surfaces of the blank; conforming the blank to have a shape corresponding to at least one of the die surface of the die press for contacting at least one of the adhesive layers with waste particles on the die surfaces and thereafter removing the blank from the die surface to separate waste particles therefrom. Apparatus for practicing the method includes a die press with opposed die and tooling components and a press ram for positioning the die and tooling components in a cleaning gap relationship; the press is periodically positioned to receive the blank with cleaning medium thereon in the press throat where the blank covers the press dies to trap waste particles on the surface of the dies during normal press operations and for removing such waste particles when the blank is removed from the press. A cleaning medium for practicing the method includes a blank of material with opposed surfaces each covered by a layer of adhesive, removes waste particles when the dies of the stamping press are moved into a cleaning gap relationship.

3 Claims, 2 Drawing Sheets

FIG 1
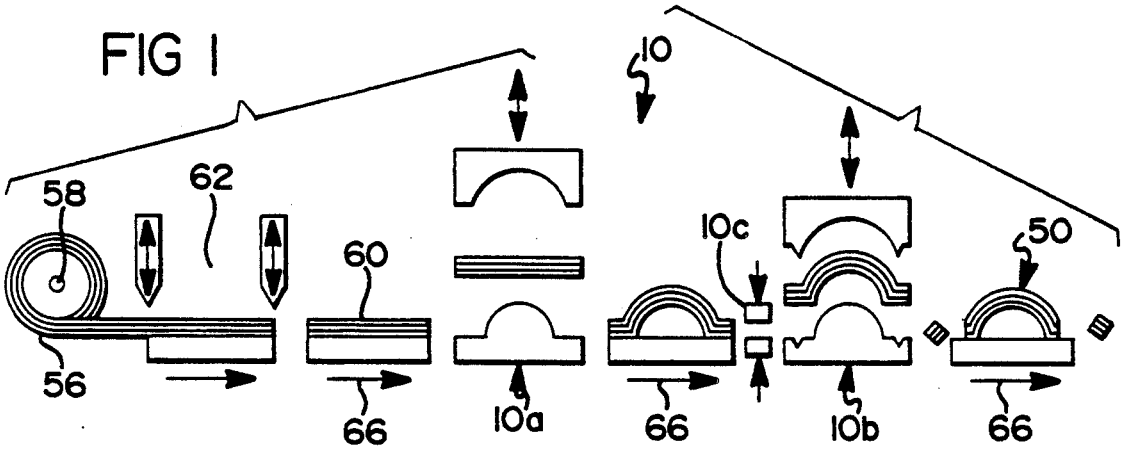
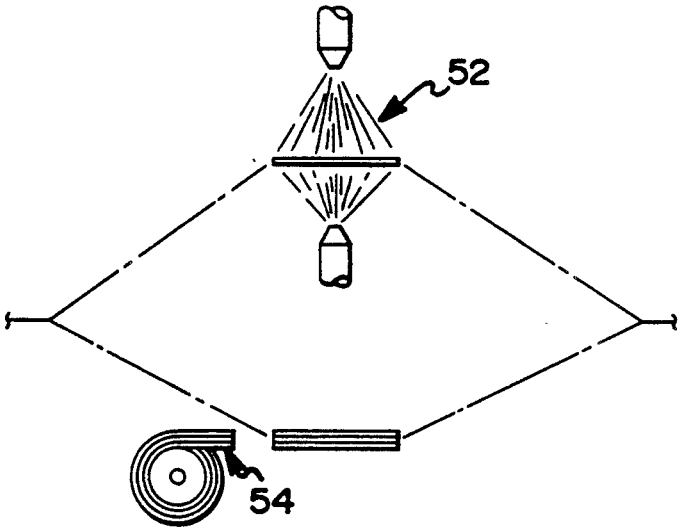
FIG 1A

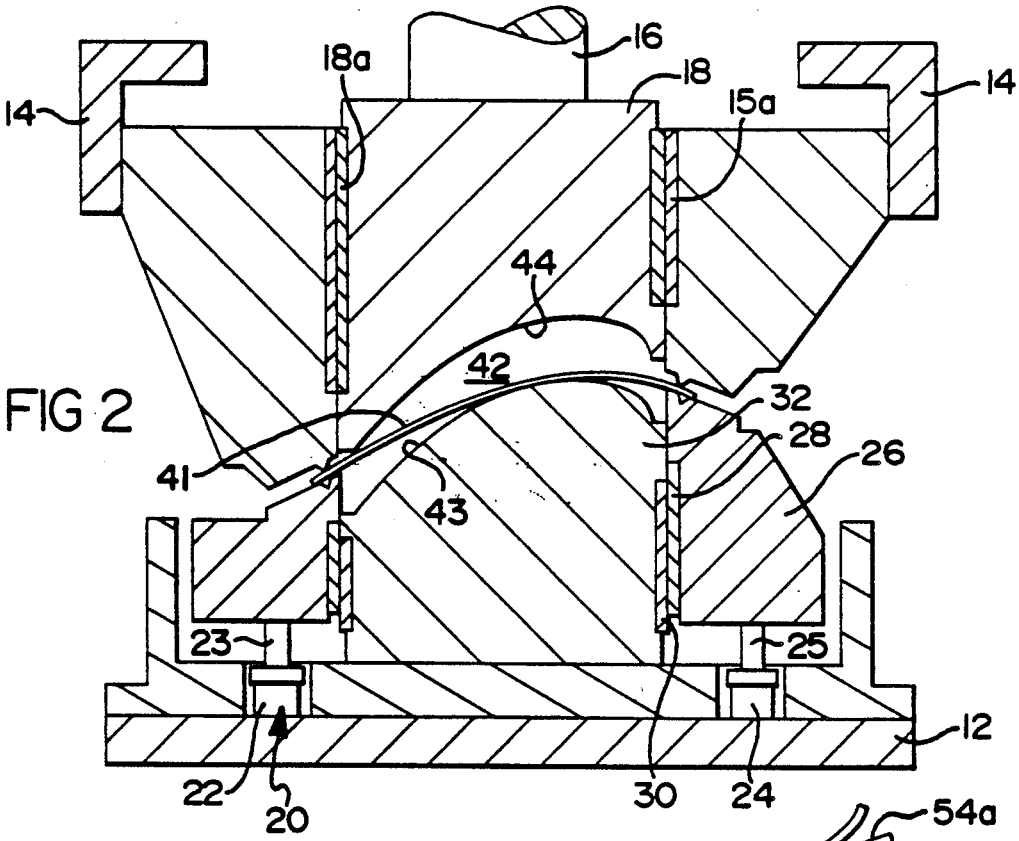
FIG 2
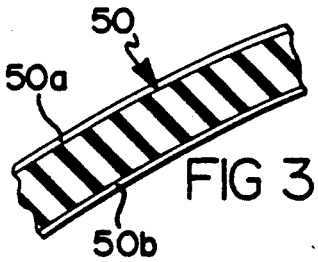
FIG 3
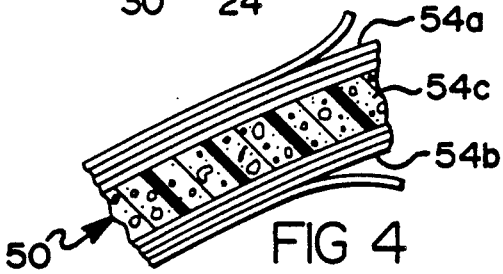
FIG 4
FIG 5
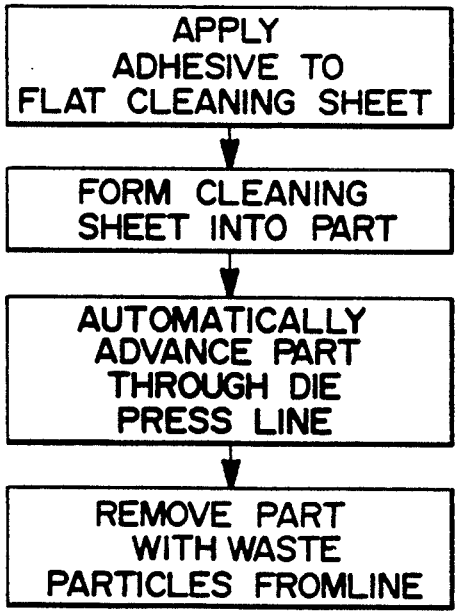

METHOD OF CLEANING STAMPING DIES

FIELD OF THE INVENTION

This invention relates to die presses and more particularly to a method, apparatus and an article for cleaning waste particles from the die surfaces of a die press.

BACKGROUND ART

Present practice for cleaning the die surfaces of sheet metal stamping presses is to stop the press line periodically during a production shift, separate the dies and then manually wipe the die surfaces to remove waste particles therefrom. Such practice presents a production line problem in that the line must be shut down for a time period to allow for such wipe-down. Another problem is that such manual wipe-down depends in part upon the care and diligence of the wiper to remove all waste particles. If the dies are not wiped perfectly clean subsequent part production can be dinged or dimpled by dirt particles remaining on the dies.

In addition to manual wiping it is known to provide apparatus for cleans dies automatically. The known automatic cleaning system is set-forth in U.S. Pat. No. 3,799,178 wherein the die is a specialty die for extruding ceramic materials. The cleaning step is performed by directing high pressure spray of cleaning material such as oil, water or a slurry of either mixed with solvent and a suitable powdered cleaning material. Such systems require an automated fluid circulation and distribution system which are not normally found on existing sheet metal stamping machines.

It is also shown in West German Offenlegungsschrift No. DT23 42 170 dated Feb. 27, 1975, that dies can be cleaned of pulverized glass used as the lubricating medium. In particular, a disc composed of mica with at least 90% of the water of crystallization removed and containing 10–15% absorbed metal salts is included on the die to avoid the buildup of glass lubricant on the die surfaces. The discs are attached to the stamping head and are present during the pressing operation. The inserts do not provide for removal of metal slivers, dirt or other waste particles generated during the stamping operation.

STATEMENT OF INVENTION AND ADVANTAGES

In accordance with the invention a method is provided to remove waste particles from the die surfaces of a sheet metal stamping machine without requiring manual wiping of the die surfaces and without requiring modification of the operating cycle of the stamping machine.

A feature of the present invention is to provide such a method wherein a blank of material is periodically interposed between the dies of the machine and conformed to the surfaces of one of the dies to trap waste particles thereon which are removed from the dies when a formed part is stripped from the dies.

Another feature of the present invention is to provide a stamping press line with means forming a cleaning blank with adhesive layers thereon wherein the cleaning blank can be periodically placed in the throat of the stamping machine when its dies are opened and placed in a cleaning gap corresponding to the stamping press die clearance provided for the blanks normally processed by the stamping press or presses in the press line.

Another aspect of the invention is to provide an article for cleaning waste particles from the surfaces of opposed stamping dies wherein the article includes a cleaning blank of material having opposite surfaces thereon shaped to conform to the press dies and wherein a layer of adhesive is formed on each of the opposite surfaces to trap waste particles when the cleaning blank is located on the surfaces of the stamping dies and wherein the cleaning blank and layers of adhesive have a combined thickness closely corresponding to or exceeding that of the sheet stock processed by the stamping dies; the cleaning blank being removable from the dies following removal of the waste particles from the surfaces of the dies.

Yet another object of the invention is to provide such an article wherein the cleaning blank includes a resilient core which will be conformed to the shape of the stamping dies during the cleaning process to trap waste particles thereon and wherein the blank is peelable from the stamping dies to remove the trapped waste particles without leaving adhesive on the stamping dies.

Other advantages of the present invention will be readily appreciated as the same becomes better understood by reference to the following detailed description when considered in connection with the accompanying drawings wherein:

BRIEF DESCRIPTION OF THE DRAWINGS

FIG. 1 is a diagrammatic view of a stamping line including the present invention;

FIG. 1A is a diagrammatic view of steps for coating a blank with adhesive material;

FIG. 2 is a diagrammatic view of die stamping apparatus including the invention;

FIG. 3 is an enlarged, fragmentary cross-section of one embodiment of an article used in the method of the present invention;

FIG. 4 is an enlarged, fragmentary cross-section of another embodiment of an article used in practicing the method of the present invention; and FIG. 5 is a flow chart of the method of the present invention.

DETAILED DESCRIPTION OF PREFERRED EMBODIMENTS

Referring now to FIG. 1, a sheet metal stamping line 10 is shown. It is representative of a stamping line having one or more die presses 10*a*, 10*b* for shaping a blank into a finished part by separate pressing operations in separate die presses which, for example, draw the blank, trim the blank, provide flange features on the blank and final trim the blank to a finished product shape.

FIG. 2 shows a double action draw press 10*a* which includes a base 12, a ram 14 connected to an upper holding ring 15 and a ram 16 connected to an upper die 18. The ring 15 and die 18 have bearings 15*a*, 18*a* which support the ring 15 and die 18 for relative sliding movement.

The base 12 also carries a lower press ram 20. More particularly, the press ram 20 is comprised of spaced pressure cylinders 22, 24. The piston rods 23, 25 of the cylinders 22, 24 engage a lower holding ring 26. The lower holding ring 26 has a bearing 28 slidably supported on the wear surface 30 of a lower stretch draw die 32.

The upper holding ring 15 is driven by ram 14 to clamp a workpiece to the lower holding ring 26. When the workpiece is clamped, the ram 16 drives the upper die 18 against the die 32 to stamp the workpiece.

The stretch draw dies 18, 32 are shown in a die open position in which the rams 14, 16, 20 are retracted. The die open position enables a sheet metal blank 41 to be located in the throat 42 of the machine for alignment with the dies 18, 32. When the dies 18, 32 are moved together, the sheet metal blank 41 is drawn across die surfaces 43, 44 and a part is formed with the desired shape. While a four piece stretch draw type stamping machine 10*a* is shown, the invention is equally applicable to a three piece die, toggle draw type machine, or a single action die press machine. Furthermore, the invention is applicable to cleaning the surfaces of transfer devices and tooling associated with the dies of machine. For example, as will be described in further detail below, the invention is capable of cleaning the surfaces of transfer grips (FIG. 1 at 10*c*) and/or iron hands for removing a progressively formed blank from one die press for transfer to a downstream die press in a given stamping plant process.

As shown in FIG. 5, the method of the present invention broadly includes the steps of providing a flat cleaning sheet 50; applying a cleaning medium such as a layer of adhesive on its outer surfaces; shaping it like the part to be processed through the stamping line 10. The part is then automatically advanced through the die press line 10 to clean the die surfaces thereof. In one embodiment, the cleaning medium is an adhesive layer which will trap waste particles on the flat cleaning sheet 50 for removal from the line 10 after the part formed from sheet 50 has been transferred therethrough.

In cases where the waste particles are ferromagnetic material other conditioning agents such as a magnetized media could be used to attract and hold the waste particles.

In the preferred embodiment of the method, a conditioning step is provided to form layers of adhesive on a flat cleaning sheet 50 of material that will be conformed to the shape of the dies and associated tooling when the dies are positioned in their normal stamping clearance relationship. Thus the method can be conducted without adjusting the operating cycle of the stamping line 10 once it is set to stamp a particular gauge sheet material.

Following the conditioning and positioning steps the method includes entrapping the waste particles on the cleaning medium (in the case of adhesive layers the waste particles are embedded and stuck to the formed part so that the particles will be removed when the part formed from the flat cleaning sheet 50 and its covering adhesive layers are stripped from the die surfaces).

The apparatus for practicing the method of the invention is shown in FIGS. 1 and 2 as including an adhesive coated flat cleaning sheet 50 having the thickness dimensions of sheet stock being processed. As shown in FIG. 1A, the sheet 50 can be preconditioned off site by a material supplier. Adhesive layers 50*a*, 50*b* can be applied by nozzle spraying 52, by electrostatic spraying or by applying double backed adhesive tape 54 to form adhesive layers 54*a*, 54*b*.

In another embodiment, the line 10 can include a coil 56 of adhesive coated sheet material supported on a transfer roll 58. In this embodiment, a strip 60 of the adhesive coated sheet material is cut at a shear station 62 and formed as an adhesive coated flat cleaning sheet 50. At periodic times in a work shift, the line 10 is automatically stopped and the sheet 50 is automatically advanced by a transfer system 66 of the press line in the same manner as the blanks being processed through the press line. The flat cleaning sheet 50 is then transferred in sequence through the presses 10*a*, 10*b* of the stamping line to cause waste particles to be cleaned from the die surfaces, associate tooling and the gripping surfaces 10*c* of the transfer system automatically by operation of the press line and without the need to reset the press line machine components or control sequence.

Specifically, at the press 10*a* during the automatic cleaning process the flat cleaning sheet 50 is located as shown in FIG. 2 to cover the surface of lower stretch draw die 32. The rams 14, 16, 20 are sequentially stroked to cause the dies to close against the sheet 50 to form a part shape. The adhesive layers are disposed to pick up waste particles from the die. The waste particles can be slivers of metal, dirt or other debris which, if not completely cleaned from the die surfaces can cause stampings to be visibly marred. The cleaning sheet 50 has an adhesive sufficiently tacky to pick up the waste particles but of sufficient adhesion to remain on the shaped part formed from the flat cleaning sheet 50 without forming a build-up of cleaning material on the die surfaces 43, 44 which might require cleaning of the die surface.

In another embodiment of the invention the cleaning medium can include a core of resilient rubber material 54*c* in FIG. 4 with opposite surfaces covered by layers of adhesive. The core has a resiliency that will cause the blank to be drawn over complex shaped dies to remove waste particles from all surfaces thereof. The invention also contemplates the use of other suitable resilient cores including metal and composite cores which will be able to conform to the shape of the stamping dies so as to locate the adhesive layers thereon in an intimate relationship with the die surfaces thereby to assure completely pick-up and removal of waste particles therefrom.

While my invention has been described in terms of certain preferred embodiments thereof, it will be appreciated that other forms could readily be adapted by one skilled in the art. Accordingly, the scope of my invention is to be considered limited only by the following claims.

What is claimed is:

1. A method for cleaning dies in a stamping press the press having first and second relatively moving dies and a press ram for closing the dies and opening the dies to permit removal of slivers and fine particles of material removed from processed sheet material during the stamping operation characterized by the steps of periodically interposing a sheet of material between said relatively moving dies to completely cover the working surfaces of said dies;

preconditioning the sheet of material by providing a layer of adhesive material thereon to attract and trap accumulated waste particles generated by the stamping process from the dies and tooling components of the stamping press as it covers the working surfaces of the dies;

positioning the press ram to close the dies into proximity with the sheet of material to cause accumulated waste particles thereon to be removed from the dies and tooling and deposited on the sheet of material; and thereafter removing the sheet of material and deposited waste particles thereon from the die press apparatus.

2. The method of claim 1, characterized by forming the sheet of material in a blank form which conforms to the shape of the stamping dies;

applying adhesive to the opposite surfaces of the blank form and thereafter passing it in a die press sequence through one or more aligned dies presses for removing waste particles from the die surfaces therefrom as well as from the surfaces of transfer devices that grip the blank form for transfer from die press to die press in the press sequence.

3. The method of claim 2, characterized by applying the adhesive on the blank form by electrostatic deposition, or spray deposition or by peeling a protective layer of material from an adhesive coating on a roll of double backed adhesive paper and adhering the exposed adhesive layer to the blank form and prior to the cleaning step removing the second protective layer from the adhesive paper to expose the other adhesive layer to one of the die surfaces.

* * * * *